US011446833B2

(12) United States Patent
Ng

(10) Patent No.: US 11,446,833 B2
(45) Date of Patent: Sep. 20, 2022

(54) FINGER-PUSH SAFETY KNIFE

(71) Applicant: ABLE TREASURE ENTERPRISE LIMITED, Hong Kong (CN)

(72) Inventor: Fu Keung Ng, Guangzhou (CN)

(73) Assignee: ABLE TREASURE ENTERPRISE LIMITED, Hong Kong (CN)

( * ) Notice: Subject to any disclaimer, the term of this patent is extended or adjusted under 35 U.S.C. 154(b) by 26 days.

(21) Appl. No.: 17/117,133

(22) Filed: Dec. 10, 2020

(65) Prior Publication Data

US 2022/0072721 A1 Mar. 10, 2022

(30) Foreign Application Priority Data

Sep. 4, 2020 (CN) ..... 202010921195.9

(51) Int. Cl.
*B26B 5/00* (2006.01)

(52) U.S. Cl.
CPC ..... *B26B 5/003* (2013.01)

(58) Field of Classification Search
None
See application file for complete search history.

(56) References Cited

U.S. PATENT DOCUMENTS

| | | | | |
|---|---|---|---|---|
| 2,607,987 | A * | 8/1952 | Bettenhausen | B26B 5/003 30/162 |
| 4,868,985 | A * | 9/1989 | Rehm | B26B 5/003 30/162 |
| 7,647,702 | B2 * | 1/2010 | Polei | B26B 5/001 30/162 |
| 10,124,495 | B2 * | 11/2018 | Gallegos | B26B 5/003 |
| 10,279,489 | B2 * | 5/2019 | Watanabe | B26B 5/003 |
| 10,589,436 | B1 * | 3/2020 | Panosian | B26B 11/006 |
| 11,161,260 | B2 * | 11/2021 | Schekalla | B26B 5/00 |
| 2015/0283712 | A1 * | 10/2015 | Garavaglia | B26B 5/001 30/162 |
| 2022/0072721 | A1 * | 3/2022 | Ng | B26B 5/001 |

* cited by examiner

*Primary Examiner* — Hwei-Siu C Payer

(57) ABSTRACT

A finger-push safety knife, including a knife housing, a knife holder, a blade, and a shifter. The blade is installed onto the knife holder. The knife holder is disposed in a cavity of the knife housing. A restricting groove is disposed on the knife holder. A gear adjustment slot is disposed on the knife housing. When the shifter rotates to the blade ejection gear, the shifter fits with the restricting groove to enable the knife holder to move and move to a preset position in the cavity, and the shifter is clamped at a blade ejection position in the restricting groove, so that the displacement of the knife holder can be restricted and the knife holder can be fastened at the preset position in the cavity under the action of an external force, to restrict an extension length of the blade from the knife housing.

5 Claims, 6 Drawing Sheets

FINGER-PUSH SAFETY KNIFE

TECHNICAL FIELD

The present invention relates to the field of knives, and in particular, to a finger-push safety knife.

BACKGROUND

Generally, the blade of a safety knife can retract into the knife housing, and when used, the blade of the safety knife can extend from the knife housing, thereby improving the safety.

However, the blades of all the existing safety knives have fixed maximum extension distances. If an extension distance needs to be reduced, only a push distance can be controlled consciously; that is, the blade is pushed to a proper place deliberately, but a push stroke of the blade cannot be adjusted directly because the push stroke of the blade is fixed at this time. However, a user self-controls a push distance in every push, resulting in various problems due to different push distances of all pushes. Therefore, the safety knife is inconvenient to use, which restricts the application of the safety knife.

SUMMARY

To overcome disadvantages of the prior art, an objective of the present invention is to provide a finger-push safety knife, which can fix a blade ejection length at a preset length, so that the safety knife is convenient to use, thereby helping expand the application of the safety knife.

The objective of the present invention is achieved by using the following technical solutions:

A finger-push safety knife includes a knife housing, a knife holder, and a blade, where the blade is installed onto the knife holder, the knife holder is slidably disposed in a cavity of the knife housing, the finger-push safety knife further includes a shifter, a restricting groove is disposed on the knife holder, a gear adjustment slot is disposed on the knife housing, and the shifter is rotatably installed on the knife housing; and a blade ejection gear and a blade locking gear are disposed in the gear adjustment slot; when the shifter rotates to the blade ejection gear under the action of an external force, the shifter fits with the restricting groove to enable the knife holder to move axially in the cavity and move to a preset position in the cavity, and the shifter is clamped at a blade ejection position in the restricting groove, so that the displacement of the knife holder can be restricted and the knife holder can be fastened at the preset position in the cavity under the action of the external force, to restrict an extension length of the blade from the knife housing; and when the shifter rotates to the blade locking gear under the action of an external force, the knife holder can move to restore to an initial position in the cavity without the action of an external force, and the shifter is clamped at a blade locking position in the restricting groove, so that the axial movement of the knife holder in the cavity can be restricted and the knife holder can be locked at the initial position in the cavity, to restrict the blade from extending from the knife housing.

Further, the blade ejection gear includes a first gear and a second gear; when the shifter rotates to the first gear, the knife holder is enabled to be locked at a first preset position in the cavity; and when the shifter rotates to the second gear, the knife holder is enabled to be locked at a second preset position in the cavity, where the distance between the first preset position in the cavity and the initial position in the cavity is greater than the distance between the second preset position in the cavity and the initial position in the cavity.

Further, the shifter includes a rotating shaft, a first shift plate, and a second shift plate, the rotating shaft is rotatably installed onto the knife housing, the first shift plate and the second shift plate are disposed on the rotating shaft, the first shift plate is located in the gear adjustment slot, and the second shift plate is located in the restricting groove.

Further, the angle formed between the first shift plate and the second shift plate is 180°.

Further, the finger-push safety knife further includes a reset assembly; when the knife holder is pushed by an external force, the reset assembly is deformed, so that the knife holder can be moved to the preset position in the cavity to enable the blade to extend from the knife housing; and when the knife holder is not pushed by an external force, the reset assembly can be restored from the deformation, so that the knife holder can retract into the initial position in the cavity.

Further, the reset assembly is located in the cavity, and two ends of the reset assembly are respectively fastened onto the knife housing and the knife holder.

Further, the reset assembly is a spring.

Further, a push part configured to be in contact with a finger is disposed on the knife holder, and a through hole communicated with the cavity is disposed on the knife housing, so that the finger can be in contact with the push part through the through hole.

Further, anti-slip convex strips are disposed on the push part.

Compared with the prior art, the present invention has the following beneficial effects:

When the blade needs to be extended from the knife housing, the shifter is enabled to rotate to the blade ejection gear, and the user uses a finger to push the knife holder to the preset position in the cavity and press the knife holder to fasten the knife holder at the position. In this way, the blade can be pushed out of the knife housing to extend by a fixed length. In addition, the shifter fits with the restricting groove, so that the shifter can be clamped at the blade ejection position in the restricting groove, to restrict the movement of the knife holder in the cavity. Therefore, it can be ensured that the blade can be pushed by the same length each time, thereby helping improve cutting efficiency, and the safety knife is convenient to use, thereby helping expand the application of the safety knife. When the pressed fastening for the knife holder is cancelled to enable the blade to retract into the knife housing, the shifter is enabled to rotate to the blade locking gear, so that the knife holder can be moved to restore to the initial position in the cavity, and the shifter is clamped at the blade locking position in the restricting groove, so that the axial movement of the knife holder in the cavity can be restricted and the knife holder can be locked at the initial position in the cavity, to restrict the blade from extending from the knife housing, thereby helping improve the safety performance of the safety knife.

In the figures: 1. Knife housing; 2. Knife holder; 3. Blade; 4. Connecting plate; 5. Restricting groove; 6. Gear adjustment slot; 7. First shift plate; 8. Second shift plate; 9. Spring; and 10. Push part 11. Blade locking gear; 12. First gear; 13. Second gear; and 14. Rotating shaft.

DESCRIPTION OF EMBODIMENTS

The following further describes the present invention with reference to the accompanying drawings and specific implementations. It should be noted that the following described embodiments or technical features may be randomly combined to form new embodiments provided that they do not conflict with each other.

Figure 1:
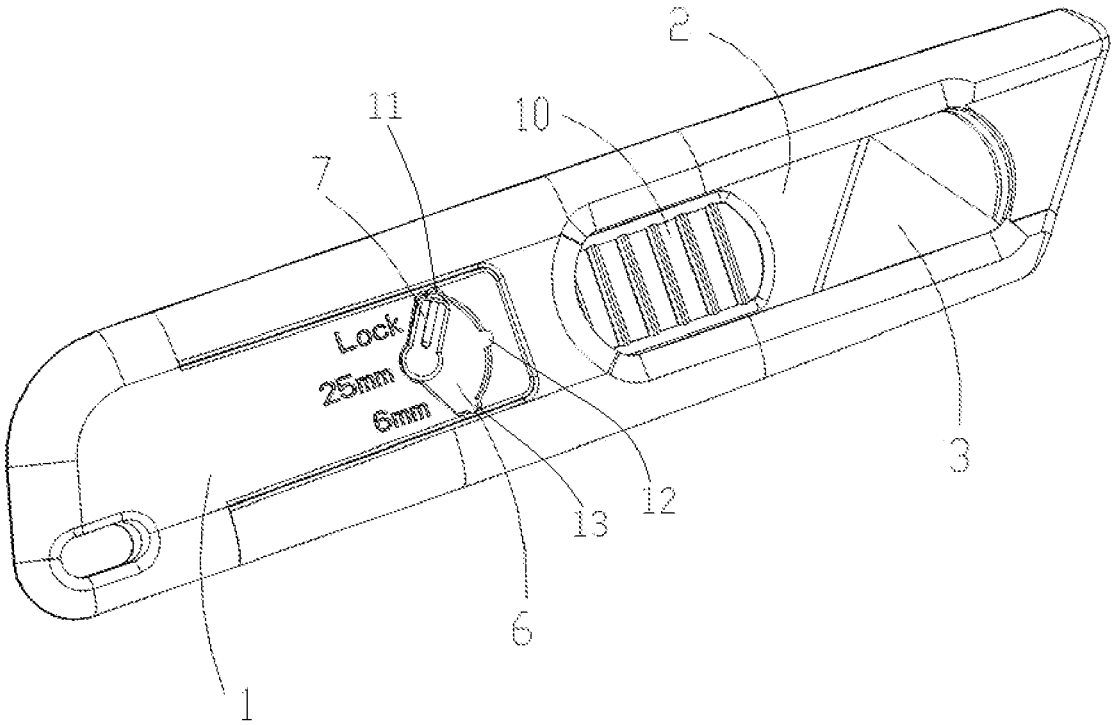
FIG. 1 is a schematic structural diagram when a shifter in a finger-push safety knife rotates to a blade locking gear according to the present invention.
Figure 2:
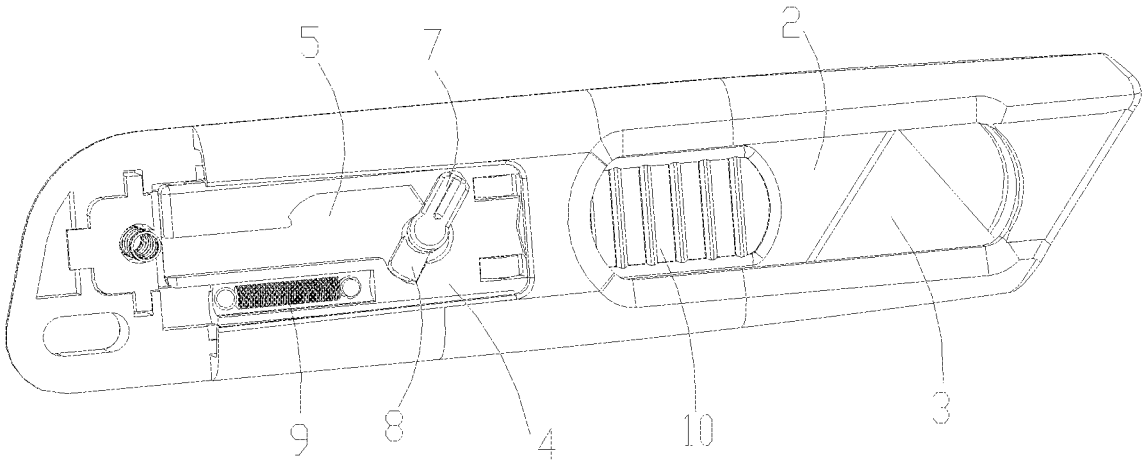
FIG. 2 is a schematic diagram of a partial structure of FIG. 1.
Figure 3:
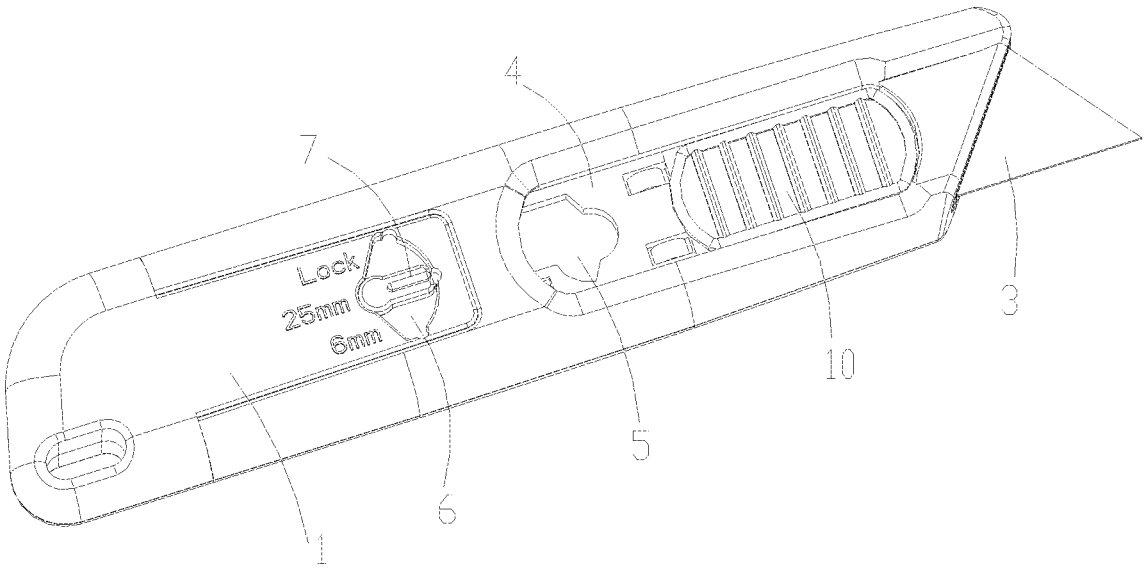
FIG. 3 is a schematic structural diagram when a shifter in a finger-push safety knife rotates to a first gear according to the present invention.
Figure 4:
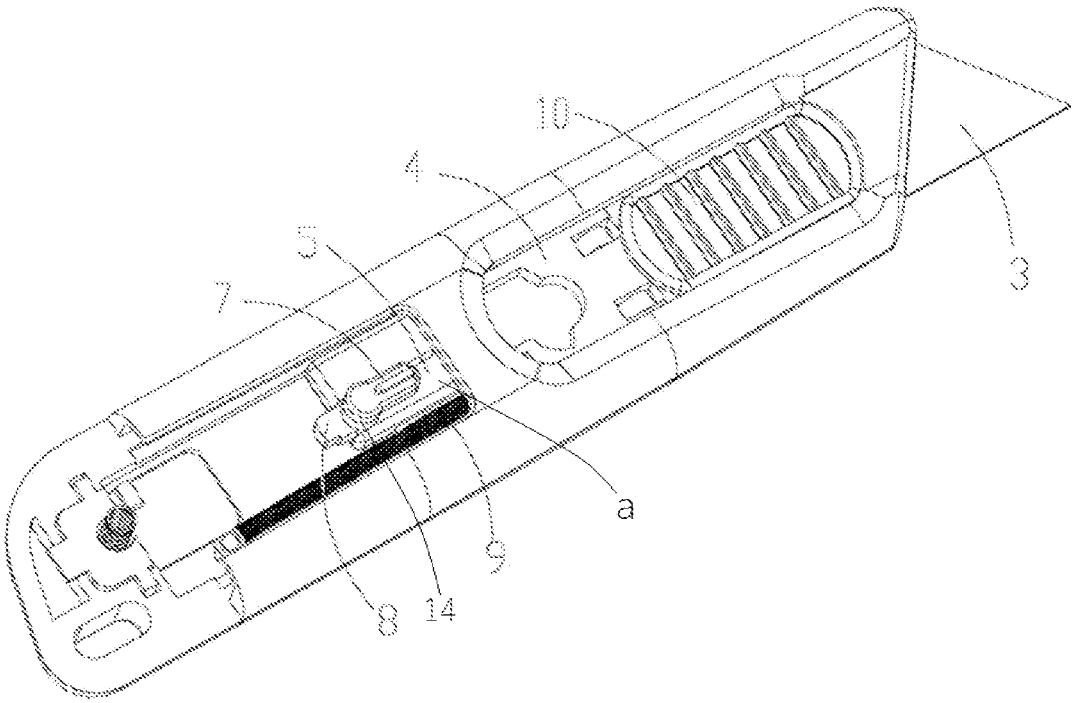
FIG. 4 is a schematic diagram of a partial structure of FIG. 3.
Figure 5:
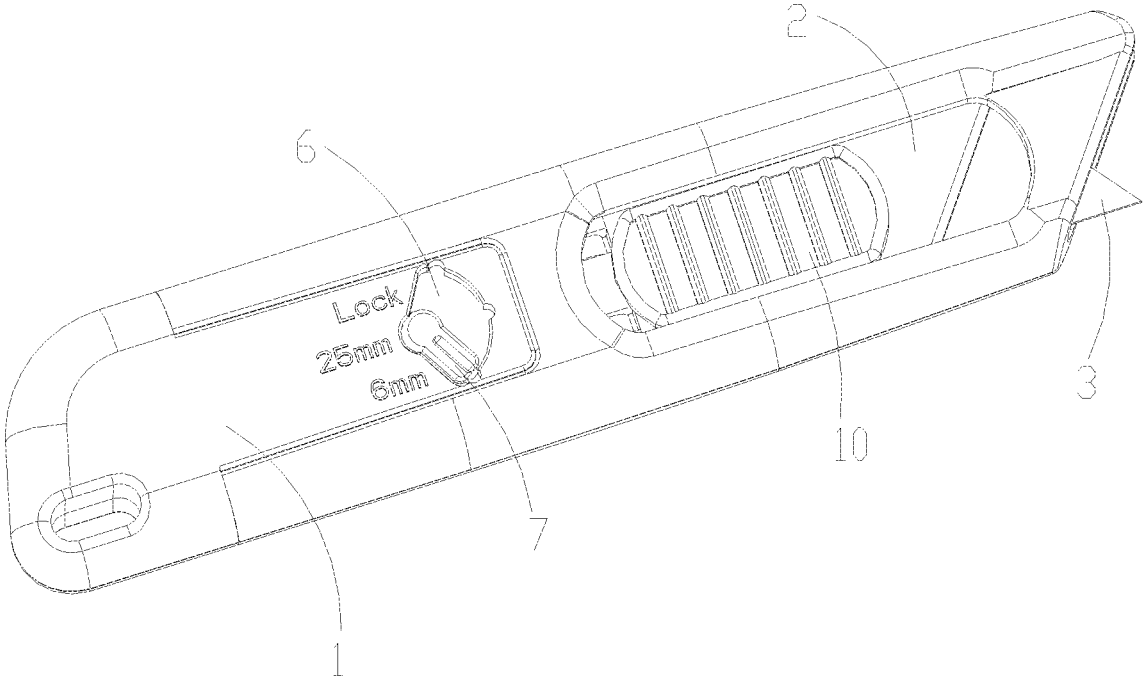
FIG. 5 is a schematic structural diagram when a shifter in a finger-push safety knife rotates to a second gear according to the present invention.
Figure 6:
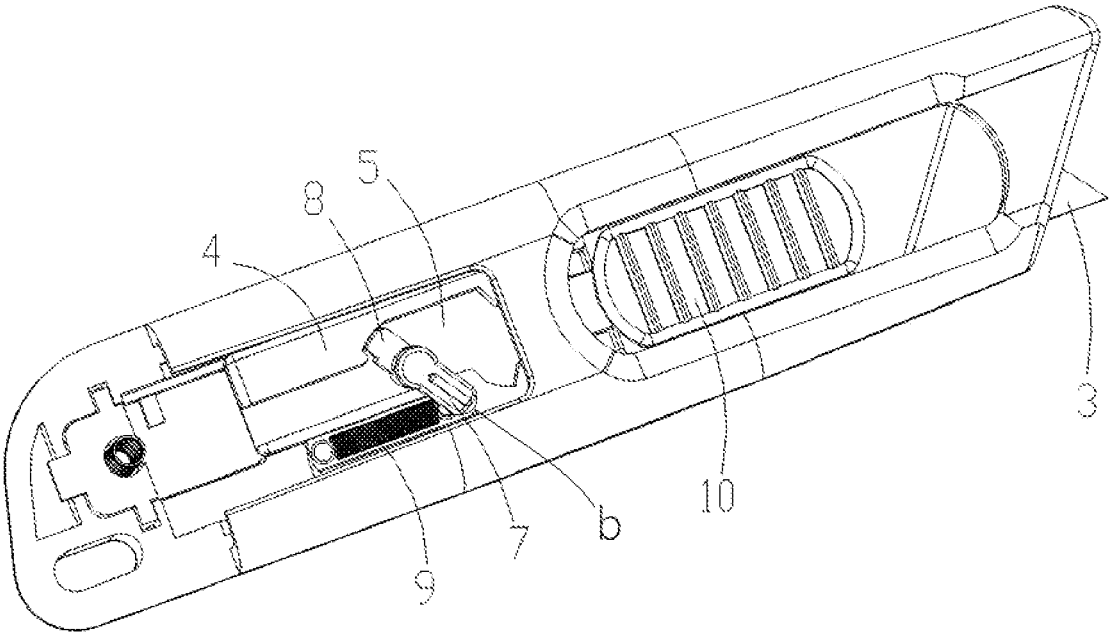
FIG. 6 is a schematic diagram of a partial structure of FIG. 5.

A finger-push safety knife shown in FIG. 1 to FIG. 6 includes a knife housing 1, a knife holder 2, and a blade 3. The blade 3 is installed onto the knife holder 2. The knife holder 2 is slidably disposed in a cavity of the knife housing 1. The finger-push safety knife further includes a shifter. A connecting plate 4 is disposed on the knife holder 2. A restricting groove 5 is disposed on the connecting plate 4. A gear adjustment slot 6 is disposed on the knife housing 1. The shifter is installed onto the knife housing 1, and the shifter can rotate in a direction vertical to the knife housing 1.

It should be noted that a blade ejection gear and a blade locking gear 11 are disposed in the gear adjustment slot 6. An external force is applied to enable the shifter to rotate. When the shifter rotates to the blade ejection gear, the shifter fits with the restricting groove 5 to enable the knife holder 2 to move axially in the cavity and move to a preset position in the cavity, and the shifter is clamped at a blade ejection position in the restricting groove 5, so that the displacement of the knife holder 2 can be restricted and the knife holder 2 can be fastened at the preset position in the cavity under the action of the external force, to restrict an extension length of the blade 3 from the knife housing 1. When the shifter rotates to the blade locking gear 11, the knife holder 2 can move to restore to an initial position in the cavity without the action of an external force, and the shifter is clamped at a blade locking position in the restricting groove 5, so that the axial movement of the knife holder 2 in the cavity can be restricted and the knife holder 2 can be locked at the initial position in the cavity, to restrict the blade 3 from extending from the knife housing 1.

Based on the structure, when the blade 3 needs to be extended from the knife housing 1, the shifter is enabled to rotate to the blade ejection gear, and a user uses a finger to push the knife holder 2 to the preset position in the cavity and press the knife holder 2 to fasten the knife holder 2 at this position. In this way, the blade 3 can be pushed out of the knife housing 1 to extend by a fixed length. In addition, the shifter fits with the restricting groove 5, so that the shifter can be clamped at the blade ejection position in the restricting groove 5, to restrict the movement of the knife holder 2 in the cavity. Therefore, it can be ensured that the blade 3 can be pushed by the same length each time, thereby helping improve cutting efficiency, and the safety knife is convenient to use, thereby helping expand the application of the safety knife. When the pressed fastening for the knife holder 2 is cancelled to enable the blade 3 to retract into the knife housing 1, the shifter is enabled to rotate to the blade locking gear 11, so that the knife holder 2 can be moved to restore to the initial position in the cavity, and the shifter is clamped at the blade locking position in the restricting groove 5, so that the axial movement of the knife holder 2 in the cavity can be restricted and the knife holder 2 can be locked at the initial position in the cavity, to restrict the blade 3 from extending from the knife housing 1, thereby helping improve the safety performance of the safety knife. Therefore, when using the safety knife, the user moves the knife holder 2 and fastens the knife holder 2 through pressing, to enable the blade 3 to extend from the knife housing 1, and the user enables the knife holder 2 to reset by cancelling the pressing for the knife holder 2, to enable the blade 3 to retract into the knife housing 1, which helps prevent the user from being cut by the blade 3 and has better safety performance.

In a preferred implementation, the blade ejection gear includes a first gear 12 and a second gear 13. An external force is applied to enable the shifter to rotate. When the shifter rotates to the first gear, the shifter fits with the restricting groove 5, to enable the knife holder 2 to move axially in the cavity and move to a first preset position in the cavity, and the shifter is clamped at a blade ejection position a in the restricting groove 5, to enable the knife holder 2 to be fastened at the first preset position in the cavity. When the shifter rotates to the second gear 13, the shifter fits with the restricting groove 5, to enable the knife holder 2 to move axially in the cavity and move to a second preset position in the cavity, and the shifter is clamped at a blade ejection position b in the restricting groove 5, to enable the knife holder 2 to be fastened at the second preset position in the cavity. The distance between the first preset position in the cavity and the initial position in the cavity is greater than the distance between the second preset position in the cavity and the initial position in the cavity.

Preferably, in this embodiment, a word mark may be set on the knife housing 1, for example, may be a "Lock" mark, to correspond to the blade locking gear 11. For the blade ejection gear, when the shifter rotates to the first gear 12 to enable the knife holder 2 to be fastened at the first preset position in the cavity, a blade ejection length is the maximum length, and a "25 mm" mark is correspondingly disposed on the knife housing 1. Likewise, when the shifter rotates to the second gear 13 to enable the knife holder 2 to be fastened at the second preset position in the cavity, a blade ejection length is a smaller length, and a "6 mm" mark is correspondingly disposed on the knife housing 1. Therefore, the blade ejection length corresponding to each gear can be clearly and institutively displayed. This helps the user make a choice quickly based on an actual need, and also helps improve cutting efficiency. Certainly, the setting of the blade ejection gear is not limited to the structure. Alternatively, more gears may be set based on actual needs, to enable the blade 3 to extend by different fixed blade ejection lengths, thereby better expanding the application of the safety knife.

In this embodiment, the shifter is a pointer-type structure. In a preferred implementation, the shifter includes a rotating shaft 14, a first shift plate 7, and a second shift plate 8. The rotating shaft is rotatably installed onto the knife housing 1. The first shift plate 7 and the second shift plate 8 are disposed on the rotating shaft. The first shift plate 7 is located in the gear adjustment slot 6, and the second shift plate 8 is located in the restricting groove 5. When in use, the first shift plate 7 can be toggled to rotate to a corresponding gear, and the second shift plate 8 can rotate synchronously with the first shift plate 7.

It is worth to mention that the angle formed between the first shift plate 7 and the second shift plate 8 is 180°.

In a more preferred implementation, the finger-push safety knife further includes a reset assembly configured to reset the knife holder 2. When the knife holder 2 is pushed by an external force, the reset assembly is deformed, so that the knife holder 2 can be moved to the preset position in the cavity to enable the blade 3 to extend from the knife housing 1. When the knife holder 2 is not pushed by an external force, the reset assembly can be restored from the deformation, so that the knife holder 2 can retract into the initial position in the cavity. In this way, the knife holder can be automatically reset by using the reset assembly, which helps the knife holder 2 retract quickly into the initial position in the cavity, to enable the blade 3 to retract quickly and conveniently.

Specifically, the reset assembly is located in the cavity, and two ends of the reset assembly are respectively fastened onto the knife housing 1 and the connecting plate 4.

Preferably, the reset assembly is a spring 9. In this embodiment, an installing groove is disposed on the connecting plate 4, and can be configured to install the spring 9. A first positioning column is disposed in the installing groove, and a second positioning column is disposed on an inner side of the knife housing 1. In this way, the spring 9 is placed in the installing groove, and two ends of the spring 9 are respectively fastened onto the first positioning column and the second positioning column, so that the knife holder 2 can slide in the cavity of the knife housing 1 and be reset under the action of the spring 9, to enable the blade 3 to extend from or retract into the knife housing 1.

In addition, a push part 10 configured to be in contact with a finger is disposed on the knife holder 2, and a through hole communicated with the cavity is disposed on the knife housing 1, so that the finger can be in contact with the push part 10 through the through hole, to enable the knife holder 2 to move or to be fastened.

In a preferred implementation, several anti-slip convex strips are disposed on the push part 10, which helps improve the pushing efficiency of the blade 3.

In addition, the knife housing 1 is detachable, so that the knife holder 2 can be conveniently removed from the cavity of the knife housing 1 to replace the blade 3.

The foregoing implementations are merely preferred implementations of the present invention, and the protection scope of the present invention cannot be limited thereto. Any insubstantial changes and substitutions made by a person skilled in the art based on the present invention fall within the protection scope claimed by the present invention.

What is claimed is:

1. A finger-push safety knife, comprising a knife housing, a knife holder, and a blade, wherein the blade is installed onto the knife holder, the knife holder is slidably disposed in a cavity of the knife housing, the finger-push safety knife further comprises a shifter, a restricting groove is disposed on the knife holder, a gear adjustment slot is disposed on the knife housing, and the shifter is rotatably installed on the knife housing; and a blade ejection gear and a blade locking gear are disposed in the gear adjustment slot; when the shifter rotates to a position of the blade ejection gear under the action of an external force, the shifter fits with the restricting groove to enable the knife holder to move axially in the cavity and move to a preset position in the cavity, and the shifter is clamped at a blade ejection position in the restricting groove, so that the displacement of the knife holder can be restricted and the knife holder can be fastened at the preset position in the cavity under the action of the external force, to restrict an extension length of the blade from the knife housing; and when the shifter rotates to a position of the blade locking gear under the action of an external force, the knife holder can move to restore to an initial position by a reset assembly in the cavity without the action of an external force, and the shifter is clamped at a blade locking position in the restricting groove, so that the axial movement of the knife holder in the cavity can be restricted and the knife holder can be locked at the initial position in the cavity, to restrict the blade from extending from the knife housing;

wherein the blade ejection gear comprises a first gear and a second gear; when the shifter rotates to a position of the first gear, the knife holder is locked at a first preset position in the cavity; and when the shifter rotates to a position of the second gear, the knife holder is locked at a second preset position in the cavity, wherein the distance between the first preset position in the cavity and the initial position in the cavity is greater than the distance between the second preset position in the cavity and the initial position in the cavity;

wherein the shifter comprises a rotating shaft, a first shift plate, and a second shift plate, the rotating shaft is rotatably disposed onto the knife housing, the first shift plate and the second shift plate are disposed on the rotating shaft, the first shift plate is located in the gear adjustment slot, and the second shift plate is located in the restricting groove;

wherein two ends of the reset assembly are respectively fastened onto the knife housing and a connecting plate disposed on the knife holder; when the knife holder is pushed by an external force, the reset assembly is deformed, so that the knife holder can be moved to the preset position in the cavity to enable the blade to extend from the knife housing; and when the knife holder is not pushed by an external force, the reset assembly can be restored from the deformation, so that the knife holder can retract into the initial position in the cavity.

2. The finger-push safety knife according to claim 1, wherein the angle formed between the first shift plate and the second shift plate is 180°.

3. The finger-push safety knife according to claim 1, wherein the reset assembly is a spring.

4. The finger-push safety knife according to claim 1, wherein a push part configured to be in contact with a finger of a user is disposed on the knife holder, and a through hole communicated with the cavity is disposed on the knife housing, so that the finger of the user can be in contact with the push part through the through hole.

5. The finger-push safety knife according to claim 4, wherein anti-slip convex strips are disposed on the push part.

* * * * *